US005507478A

United States Patent [19]

Nottingham et al.

[11] Patent Number: 5,507,478

[45] Date of Patent: Apr. 16, 1996

[54] PRINTING MEDIA STATUS SENSING

[75] Inventors: James R. Nottingham, Boise; Billy L. Knorpp, Meridian, both of Id.

[73] Assignee: Hewlett-Packard Company, Palo Alto, Calif.

[21] Appl. No.: 309,309

[22] Filed: Sep. 20, 1994

[51] Int. Cl.[6] ..... B65H 5/00

[52] U.S. Cl. ..... 271/10.02; 271/110; 271/265.01

[58] Field of Search ..... 271/10.01, 10.09, 271/10.11, 110, 265.01, 10.02, 10.03, 4.02, 4.03, 4.08, 4.1

[56] References Cited

U.S. PATENT DOCUMENTS 4,548,394 10/1985 Koyama et al. ..... 271/10.11 X
5,035,413 7/1991 Yamada et al. ..... 271/10.03 X

FOREIGN PATENT DOCUMENTS 4-266344 9/1992 Japan ..... 271/10.11

*Primary Examiner*—David H. Bollinger

[57] ABSTRACT

A printing media position sensing device provides sheet medium position status information for synchronizing media transfer operations in a hard copy machine using a sheet feeder system. When a sheet is picked and transferred from a stack in a replaceable cartridge, refillable tray, or the like, to the input registration and feed mechanism of the hard copy machine, a detector senses the further exit motion of the picked sheet, thus providing an indication that the input registration and feed mechanism has taken control of the sheet. A signal indicative of this condition is used to release the sheet pick and transfer mechanism associated with the stack so that the sheet is free to leave the stack uninhibited. The exit sensor automatically resets for the next cycle.

15 Claims, 5 Drawing Sheets

PRINTING MEDIA STATUS SENSING

FIELD OF THE INVENTION

The present invention relates generally to print media sheet feeders for hard copy printing and plotting apparatus and, more particularly, to a device for detecting the status of a print medium sheet before and during transfer from a media supply stack into a hard copy machine.

BACKGROUND OF THE INVENTION

Many office products such as computer printers and plotters, plain paper facsimile machines, and photocopiers use mechanisms that transfer a single sheet of pre-cut printing medium (for example, a sheet of paper of a particular size such as 8½×11 letter, 8½×14 legal, or A-4 (metric), or transparencies, or envelopes) from a replenishable supply stack to the hard copy producing apparatus. These mechanisms are commonly referred to as "sheet feeders."

Sheet feeders usually are provided with an adjustable or replaceable media cartridge, tray, or other type of stacker in which a user can stack multiple cut-sheets of a media of choice. The use of media cartridges (essentially easily substituted paper trays) adapted to the various styles and sizes of media provide a mechanism for quick changes between any particular printing medium chosen by the user.

Upon receiving a media feed command from a host computer or the hard copy machine controller electronics (exemplary "FEED command" hereinafter), a sheet picking and transferring subsystem of the sheet feeder is actuated to deliver the top sheet from the stack to the hard copy machine. Under proper operating conditions, a sheet picking and transferring mechanism associated with the stacker should deliver a single sheet of the print medium to a hard copy machine input mechanism, such as a set of pinch rollers used for registration and feed of a single sheet into the actual printing station of the machine.

Misfeeds, multiple sheet picks, paper jams, and the like, are common problems associated with sheet feeders.

Therefore, there is a need to facilitate the transfer of a sheet of print media from a stack picking and transferring subsystem associated with the sheet feeder to a hard copy machine input mechanism.

SUMMARY OF THE INVENTION

In its basic aspects, the present invention provides a print medium status detecting device for a cut-sheet print media apparatus adapted to hold a replenishable stack of cut-sheet media and having a subsystem for transferring a single sheet from the stack to a print media input mechanism of a hard copy machine. The invention includes a transmissive sensor, affixed to the apparatus and connected to said subsystem for transferring, for providing a first signal indicative of a single sheet first status condition and a second signal indicative of a single sheet second status condition; and a detector, operatively coupled to the sensor, for detecting motion of a single sheet from the first status condition.

It is an advantage of the present invention that it provides an economical, easily manufacturable mechanism for sensing print media sheet feed motion detection.

It is another advantage of the present invention that it is not directly in the media path and therefore is not a source of paper misfeeds, jams, or the like.

It is still another advantage of the present invention that it reacts substantially coincidently with the hard copy machine media input mechanism inception of feeding a received cut-sheet of media.

Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventors for practicing the invention. Alternative embodiments are also briefly described as applicable. In order to facilitate the description of the present invention, the details will be described in terms of a cut-sheet paper sheet feed construct. It should be recognized that the concept is universally applicable to all forms of print media and that no limitation on the scope of the invention is intended by the inventors nor should any be implied from the description in terms of such an exemplary embodiment.

Figure 1:
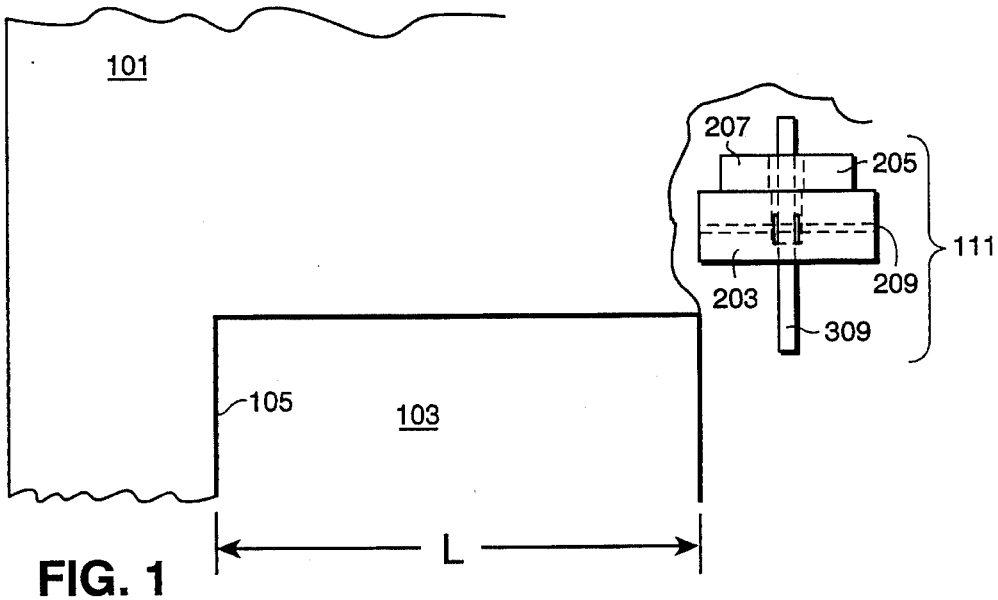
FIG. 1 is a sectional plan view (top) in partial, cut-away showing the present invention mounted in a relative mounting position with respect to a cut-sheet print media cartridge, tray, or the like cut-sheet stacking apparatus.

Referring to FIG. 1, the present invention is depicted in situ (overhead view). A hard copy machine generally has a refillable paper tray or a docking station for replaceable paper cartridges. A cutaway, housing section 101 is shown that can represent either the hard copy machine region where a refillable tray is housed or a part of such a cartridge mechanism which is adapted to be inserted into, or to otherwise be operatively associated with, the hard copy machine. The tray, or the cartridge housing, 101 has a paper stacking region 103 adapted to receive a supply of cut-sheet media (not shown, but see FIGS. 4–6). A biasing mechanism (not shown) generally is provided to keep the top of the stack in contact with a paper pick and transfer subsystem (see FIGS. 4–6) by a force which in this depiction would be generally toward the viewer. In general, such hard copy machines have registration rollers adapted to grip the leading edge of a sheet paper once it has been picked from the stack which it then feeds into a printing station where the hard copy is produced (see FIG. 6).

The media position status and motion detection device of the present invention, referred to generically as "the exit sensor" 111 is shown mounted in its relative position from the edge of paper, that is, a predetermined distance "L" from the edge of the paper stack fence 105.

Figure 2A:
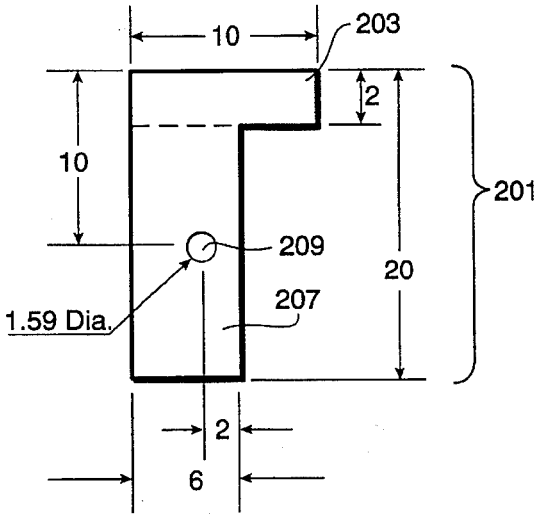
FIGS. 2A and 2B are orthogonal plan views (side and front, respectively) of a mount portion of the present invention as shown in FIG. 1.
Figure 2B:
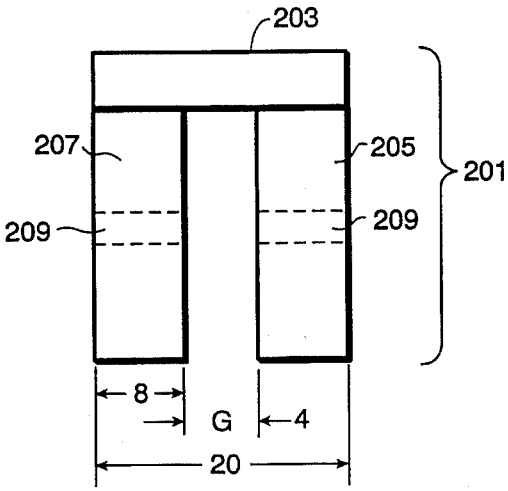

Turning to FIGS. 2A and 2B, an exit sensor mount 201 is shown in two orthogonal views. While dimensions are relative to any specific design, suggested measurements (in millimeters) are shown to give a general sense of scale of the present invention. The mount 201 may be machined, molded, or otherwise produced of materials of convenience such as metal or plastic. The mount 201 includes a mounting plate 203 adapted to be fixed (glued, welded, attached with fasteners, or the like, as a design expediency) to a rigid piece of the structure (that is, either part of the hard copy machine framing where the refillable tray is located, or within the cartridge mechanism itself. The exit sensor 111 is affixed using the mount 201 in a predetermined position and orientation as will be detailed hereinafter. For ease of explanation, while the present invention is easily adaptable to many hard copy machines, the remainder of the detailed description will assume a self-contained cartridge mechanism, including sheet picking and transferring subsystem, adapted with appropriate electromechanical interfaces to the hard copy machine.

Two descending arm members 205, 207 having a gap "G" therebetween are provided with aligned bore holes 209. The mount 201 can be manufactured for convenience as a unitary part or assembly piece parts. The bore holes 209 are designed to carry a rotating axle (not shown in FIG. 2) to be described hereinafter.

Figure 3:
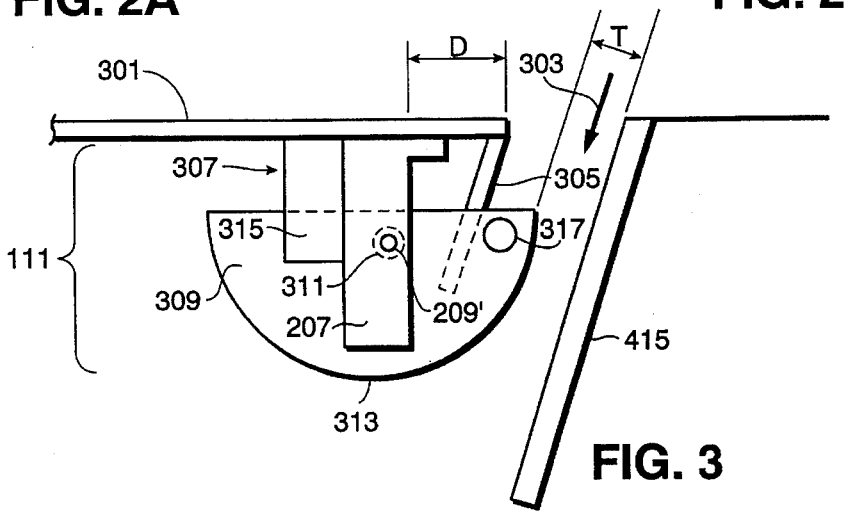
FIG. 3 is a plan view (side) of the present invention as shown in FIG. 1 mounted for operation in a section of an exemplary print media cartridge or tray.

Referring now to FIG. 3, a side view of the exit sensor 111 is shown as mounted on a top plate 301 of the cartridge housing 101. The top plate 301 has a sheet exit port gap 303 through which a sheet of paper from the stack (not shown in this FIGURE) is transferred to the hard copy machine. A top plate lip 305 acts as a paper guide as the leading edge of a sheet from the stack is transmitted through gap 303. Adjacent to the mount 201 is a signal device 307. The signal device 307 is a commercially available transmissive sensor. For example, interrupt switches such as the Telefunken electronic GmbH TCYS5201 optical sensor with Schmitt-trigger logic output or the Allegro Microsystems Hall-effect switch, model 3113, have been determined to be suitable for use in the present invention.

A switching flag 309 is used as a paper motion detector and a trigger for the signal device 307. The flag 309 is a hemispherical member, generally having a "D"-shape, mounted for rotation about an axle 209' adapted to fit for free rotational motion in the mount bore holes 209. The flag 309 thus hangs in what is effectively a pendulum-like manner with its D-shaped curved rim 313 depending about rotational axis 209'. Referring briefly to FIGS. 1 and 2, it can be seen that the flag 309 hangs without interference in gap "G" between the arms 205, 207 of the mount 201. Spacing washers 311 may be provided as needed.

Critically, a region 315 of the flag transects the signal device 307 such that it is set to provide one of its output signals. With the flag 309 at this "home" position, the signal is indicative of paper status ranging from a condition where there is no paper present in the tray to a condition in which a sheet has been picked from a stack in the tray and transferred to an input mechanism of the hard copy machine but is not yet being fed into the machine under the control of that input mechanism.

Figure 4:
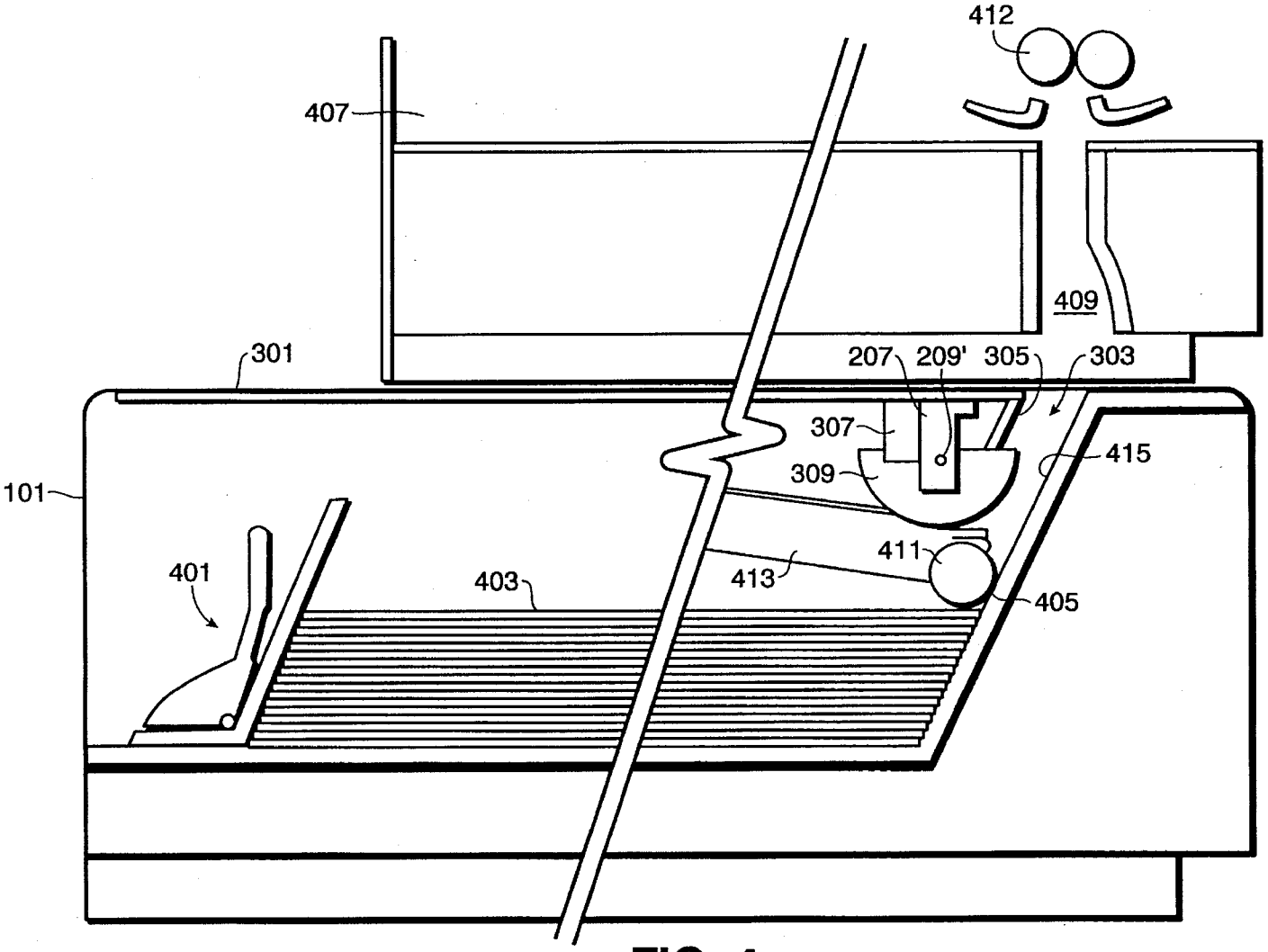
FIG. 4 is a plan view (side) of the present invention mounted in a refillable media tray subsystem, depicting the invention in its operational position before a sheet is picked from a stack of paper for transfer to a superjacent hard copy machine.
Figure 5:
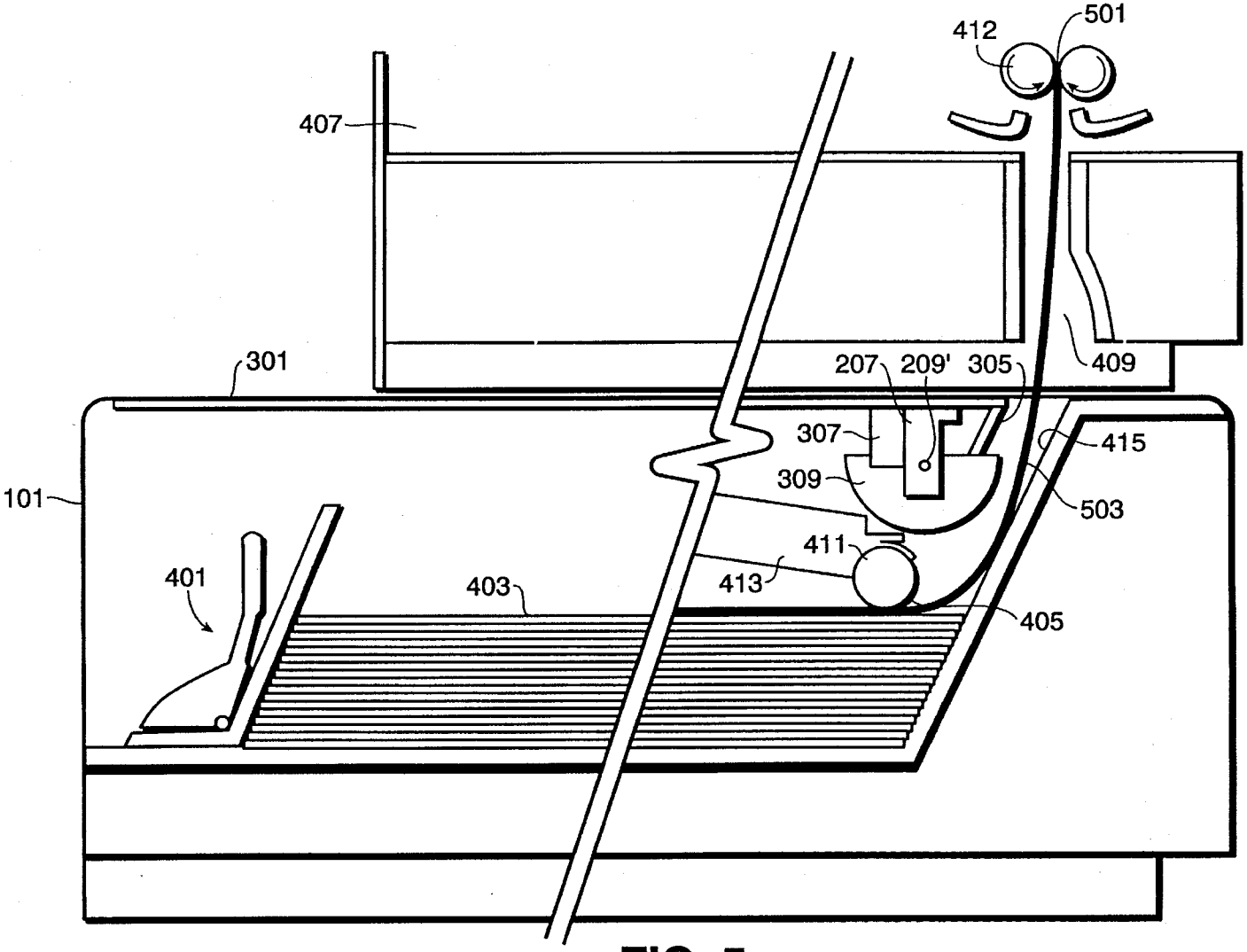
FIG. 5 is a plan view (side) of the present invention mounted in a refillable paper tray subsystem as shown in FIG. 4, depicting the invention in its operational position after a sheet is picked from a stack of paper and transferred to a superjacent hard copy machine with the leading edge .of the sheet presented to a set of hard copy machine input rollers.
Figure 6:
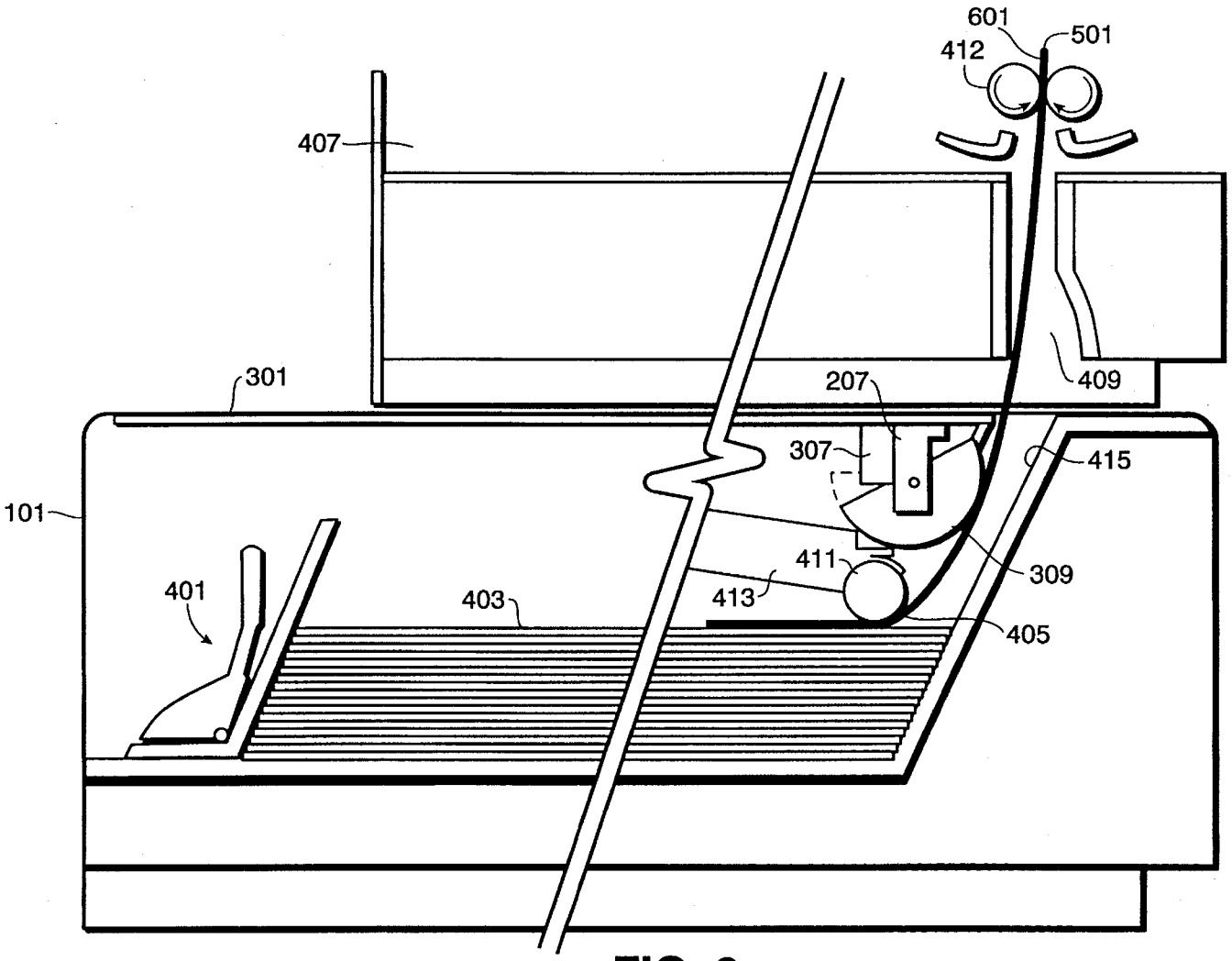
FIG. 6 is a plan view (side) of the present invention mounted in a refillable paper tray subsystem as shown in FIG. 5, depicting the invention in its operational position as the hard copy machine input rollers feed the picked sheet into the hard copy machine.

FIGS. 4, 5 and 6 are depictions of the various stages of operation of the present invention. A cartridge housing 101 includes a mechanism 401 for aligning a stack of paper 403 with a paper pick and transfer mechanism 405. The cartridge housing 101 is shown wherein the sheet exit port gap 303 is in registered alignment with a hard copy machine 407 sheet receiving port region 409. Adjacent the sheet receiving port region 409 is a set of registration rollers 412 as would be known in the art for receiving the leading edge of a sheet picked from stack of paper 403 and transferred through the receiving port region 409.

In FIG. 4, the flag 309 is in its "home" position. That is, a paper FEED command has not yet begun execution by the paper pick and transfer mechanism 405. As the FEED command is executed, the pick and transfer mechanism 405 will by the turning of tray roller(s) 411 mounted on arm 413 transfer a top sheet from the stack 403 along slanted wall 415, though sheet exit port gap 303 and into the hard copy machine 407 receiving port region 409.

As shown in FIG. 5, when the leading edge 501 of the sheet of paper reaches the registration rollers 412 of the hard copy machine 407, the paper will begin to buckle at region 503. Generally, at this point in the FEED command cycle, an input motor will be turned on such that the registration rollers 412 will beginning turning in the direction indicated by the arrows to grasp the sheet and feed it into a printing station (not shown).

Referring now to FIG. 6, as the picked sheet 601 is fed into the hard copy machine printing station by the registration rollers 412, the sheet 601 is drawn taut and contacts the curved rim of the flag 309. Friction between the surface of the flag rim and the moving sheet 601 rotates the flag 309 about its axle 209 away from its free-weight position. As it rotates from this home position, the flag region 315 that activates the signal device 307 is moved such that the signal device 307 is toggled in accordance with its design specifications. That is, the moving flag 309 trips the signal device 307 which then sends a different signal that is now indicative that the sheet 601 is under motion control by the hard copy machine registration rollers 412.

Referring back to FIG. 3, it can now be understood that the positioning of the exit sensor 111 with respect to the gap 303 is an important design criteria. The distance "T" from the wall 415 against which the buckled paper is guided into the hard copy machine to a tangent line of the curved rim 313 of the flag 309 must be designed such that once the paper is pulled taut (FIG. 6), the paper surface exerts enough friction against the flag rim 313 to swing the flag 309 out of its free-weight, home position sufficiently to trigger the signal device 307. For example, for a mount such as shown in FIG. 2, affixed to the top plate 301 set back at a distance "D" of ten millimeters from the gap 303 edge, the flag 309 will have a radius from the axle 209' of fifteen millimeters when the distance "T" is three to four millimeters and axle 209' is three millimeters in from the flat edge of the D-shape member.

As the paper sheet 601 moves into the hard copy machine under control of the registration rollers 412 (FIG. 6), it is desirable for the flag 309 to return to its home position prior to the next FEED command cycle initiation. Thus, the flag 309 is to be weighted accordingly to slide under its weight, or an added adjustment weight 317, as the friction is overcome by weight and the flag 309 slips against the friction of the paper-to-rim interface and returns back to its home position (FIG. 4).

Figure 7:
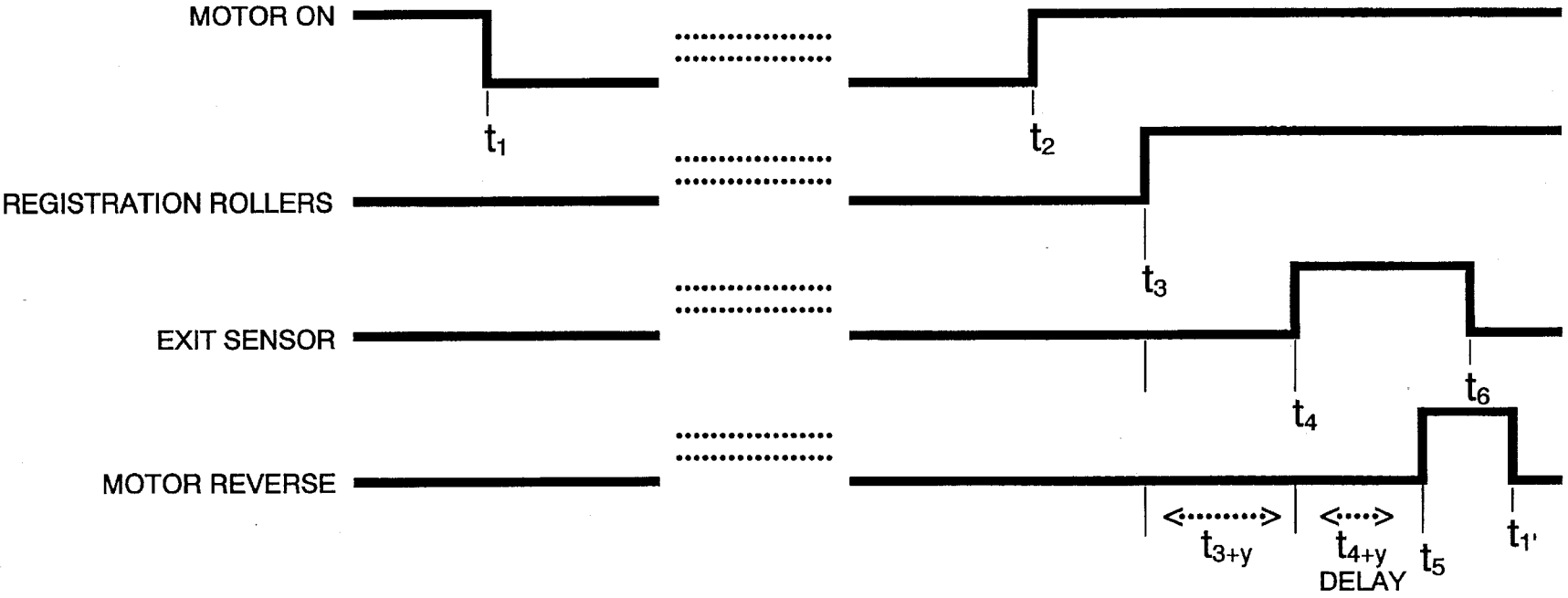
FIG. 7 is a timing diagram for signals associated with the present invention as shown in FIGS. 4, 5, and 6.

Signal generation is shown in FIG. 7. In operation, a motor (not shown) would be activated—Motor On signal goes low at $t_1$ —by a FEED command from the host. A sheet of paper is picked by a device as would be known in the art and driven to a position where its leading edge is appropriately positioned at the registration rollers for feeding into the hard copy machine printing station. This position is shown in FIG. 5. Once the leading edge of the paper has reached the registration rollers, the motor is stopped—$t_2$—and held in position.

When the printing station is ready to receive a new sheet of paper, the registration rollers are activated—Registration Rollers signal goes high at $t_3$. Once it is captured by the registration rollers and feeding into the hard copy machine has begun, the buckled sheet of paper is pulled taut as shown in FIG. 6. As it does so, it is drawn taut across the detector flag of the present invention as shown in FIG. 6. Further motion of the paper starts the flag moving about its pivot point. At some time thereafter—$t_{3+x}$—, the exit sensor is tripped—Exit Sensor signal goes high at $t_4$. This is an indication that the hard copy machine registration rollers have taken over control of the sheet in the paper feed cycle. After a suitable delay—$t_{4+y}$—selected in accordance with the operating specifications of the particular components employed in the design, the transfer and pick subsystem motor clutch can be released—Motor Reverse signal goes high at $t_5$—such that the paper is free to leave the tray under the sole control of the registration rollers. The detector flag will slip and return to its free weight position—Exit Sensor signal goes low at $t_6$ until the next cycle begins—$T_1$. The cycle is then free to repeat on host demand.

The exit sensor 111 of the present invention provides a fast reaction —on the order of 250 milliseconds—to the inception of feeding a cut-sheet by the hard copy machine input registration rollers, yet without being directly in the paper path. Thus, the exit sensor 111 will not itself be another source of paper jams, misfeeds, multiple sheet picks, or the like.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A print medium status device for a cut-sheet print media apparatus adapted to hold a replenishable stack of cut-sheet media and having a means for transferring a single sheet from said stack to a print media input means of a hard copy machine, said device comprising:

a sensor, affixed within said cut-sheet print media apparatus and connected to said means for transferring, providing a first signal when a single sheet is located at any position between being in said stack and a position where said single sheet has a leading edge thereof positioned to be fed into said hard copy machine by said input means and a second signal when said input means moves said single sheet out of said any position and feeds said single sheet into said hard copy machine such that said single sheet is released from said means for transferring; and switching means, operatively coupled to said sensor for switching said sensor from providing said first signal to providing said second signal substantially coincidently with said print media input means inception of feeding said single sheet into said hard copy machine.

2. The device as set forth in claim 1, wherein said switching means further comprises:

said switching means being adapted to switch said sensor from providing said second signal to providing said first signal as said sheet is fed into said hard copy machine such that said sensor and said switching means are in a condition to provide print medium status condition of a next sheet of said stack.

3. The device as set forth in claim 2, wherein said switching means comprises:

a trigger device, adapted to be moved by said first sheet being fed by said input means into said hard copy machine from a first position in which said sensor is providing said first signal to a second position in which said sensor is providing said second signal wherein said first sheet is released by said means for transferring.

4. The device as set forth in claim 3, wherein said trigger device further comprises:

said trigger device being adapted to reset said sensor to provide said first signal after said first sheet is released by said means for transferring and prior to said means for transferring starting to transfer said next sheet from said stack.

5. The device as set forth in claim 1, further comprising:

said sensor and said switching means are affixed to said apparatus adjacent to but not in a direct path of said sheet being transferred from said stack to said print media input means.

6. A motion detector for a cut-sheet print media picking and transferring apparatus having a stack of cut-sheet print media therein and adapted for use with a hard copy machine having an input mechanism for repetitively receiving consecutive single sheets of media from said apparatus and feeding each of said sheets of media into a hard copy machine printing subsystem, comprising:

a digital sensor, mounted within said apparatus, providing a first state signal from when said picking and transferring apparatus is set to pick and transfer a sheet from said stack until said sheet is transferred to and moved by said input mechanism; and toggling means, adapted to come into frictional contact with said sheet as said sheet is fed by said input mechanism into said hard copy machine printing subsystem, for switching said digital sensor from providing said first state signal to providing a second state signal as frictional contact between said toggling means and said sheet being fed move said toggling means, said second state signal causing said sheet to be released by said picking and transferring apparatus.

7. The motion detector as set forth in claim 6, wherein said toggling means further comprises:

said toggling means is adapted to reset said digital sensor to providing said first state signal prior to picking and transferring apparatus being commanded to pick and transfer a next sheet from said stack.

8. The motion detector as set forth in claim 7, wherein said toggling means further comprises:

said toggling means is adapted to come into sliding frictional contact with said sheet as said sheet is fed by said input mechanism into said hard copy machine printing subsystem such that subsequent to said switching of said digital sensor from providing said first state signal to providing said second state signal said toggling means slides to a position to reset said digital sensor to providing said first state signal as sheet is being fed.

9. The motion detector as set forth in claim 8, further comprising:

said digital sensor is a transmissive sensor, and said toggling means is a D-shaped flag member adapted to trigger said sensor when a frictional force between said sheet being fed by said input mechanism and said flag member moves said flag member from its free weight position.

10. The motion detector as set forth in claim 6, further comprising:

said sensing device and said triggering device are mounted in a predetermined position such that said sheet is transferred from said picking and transferring apparatus to said input mechanism in a path wherein said sheet makes only tangential contact with said triggering device.

11. In a refillable, cut-sheet print media apparatus for use with a hard copy machine, said apparatus having a stack of cut-sheet media therein, a sheet picking and transferring subsystem, and an interface for transferring a sheet from the apparatus to an input mechanism of the hard copy machine via a paper path at a predetermined transfer angle to the planar orientation of said stack, a print medium exit sensor comprising:

a status sensor, affixed to said apparatus, for providing a first signal to said picking and transferring subsystem indicative of a top sheet of said stack being in any position between atop said stack and a position in which a leading edge of said sheet is engageable with said input mechanism, and for providing a second signal to said picking and transferring subsystem indicative of said sheet being engaged and fed by said input mechanism into said hard copy machine; and a trigger, coupled to said status sensor and in proximity to said interface such that a sheet engaged and being fed by said input mechanism into said hard copy machine is brought into frictional contact with said trigger due to said paper path transfer angle, said frictional contact causing said trigger to move and thereby change said status sensor from a condition of providing said first signal to a condition of providing said second signal.

12. The print medium exit sensor as set forth in claim 11, wherein said status sensor further comprises:

a digital interrupt switch providing said first signal when said trigger is in a switch interrupt position and said second signal when said trigger is in a switch non-interrupt position.

13. The print medium exit sensor as set forth in claim 12, said trigger further comprising:

a member having a hemispherical surface portion for frictional contact with said sheet, mounted for rotation with respect to said digital interrupt switch such that said member is in said switch interrupt position until moved therefrom by said frictional contact with said sheet.

14. The print medium exit sensor as set forth in claim 13, said trigger further comprising:

said hemispherical surface portion being positioned such that said frictional contact is a sliding contact wherein said trigger returns to said switch interrupt position prior to said picking and transferring subsystem picks a next sheet from said stack.

15. The print medium exit sensor as set forth in claim 11, further comprising:

said exit sensor being affixed to said device in a predetermined position such that it is not directly in said paper path.

* * * * *